US006182889B1

(12) United States Patent
Heeley et al.

(10) Patent No.: US 6,182,889 B1
(45) Date of Patent: Feb. 6, 2001

(54) PACKAGE WITH PEAK CLOSURE

(75) Inventors: John Heeley, Munich (DE); Alain Ernest Michel Kowalewski, Strasbourg; Jean- Phillipe Rapp, Ostwald, both of (FR); Luigi Tettamanti, Asso (IT)

(73) Assignee: Kraft Jacobs Suchard R&D, Inc., Munich (DE)

( * ) Notice: Under 35 U.S.C. 154(b), the term of this patent shall be extended for 0 days.

(21) Appl. No.: 09/358,319

(22) Filed: Jul. 21, 1999

(30) Foreign Application Priority Data

Jul. 24, 1998 (EP) ..... 98113891

(51) Int. Cl.[7] ..... B65D 5/08
(52) U.S. Cl. ..... 229/138; 229/139; 229/221
(58) Field of Search ..... 229/137, 138, 229/139, 221, 222

(56) References Cited

U.S. PATENT DOCUMENTS

| | | | | |
|---|---|---|---|---|
| 1,147,652 | * | 7/1915 | Scudder | 229/139 |
| 2,305,365 | * | 12/1942 | Wentz | 229/138 |
| 2,307,913 | * | 1/1943 | Bergstein | 229/139 |
| 2,345,486 | * | 3/1944 | Leebov | 229/222 |
| 3,853,260 | * | 12/1974 | Wood | 229/139 |
| 4,099,665 | * | 7/1978 | Bergstein | 229/221 |
| 4,690,282 | * | 9/1987 | Ghini | 229/137 |
| 5,482,204 | * | 1/1996 | Mills et al. | 229/137 |

FOREIGN PATENT DOCUMENTS

| | | | |
|---|---|---|---|
| 0677446 A2 | | 10/1995 | (EP) . |
| 775928 | | 10/1934 | (FR) . |
| 657034 | * | 9/1951 | (GB) ..... 229/139 |
| 280630B | | 8/1978 | (GB) . |

* cited by examiner

*Primary Examiner*—Gary E. Elkins
(74) *Attorney, Agent, or Firm*—Thomas A. Marcoux

(57) ABSTRACT

In order to provide a package which is inexpensive to manufacture, sufficiently stable to protect the contents of the package and repeatedly and consistently openable and closeable, a package and a blank therefor is disclosed. The blank comprises front wall (10) , back wall (14) and side wall (12) segments, and the front and the back wall segments extend into congruent closure segments (20, 24, 32, 28). At least two (24, 26) of the closure segments are arranged to be foldable on top of one another to form a pocket with one open side (26) At least a further one of the closure segments (20) is arranged to be insertable into the pocket from the open side thereof in such a manner as to permit repeatable opening and closing of an end of the package.

24 Claims, 2 Drawing Sheets

PACKAGE WITH PEAK CLOSURE

TECHNICAL FIELD

The present invention relates generally to containers and particularly to packages which are folded from a single package blank and to package blanks as such. Conveniently, the packages can be used for storing, shipping, shop presentation and by the end user, especially in connection with loose foodstuff.

BACKGROUND ART

Numerous packages which are foldable from a single package blank are known in the art. For example, DE 44 07 877 A1 discloses a cube-shaped container with a bottom wall, side walls, and a hinged lid. The lid is provided with a triangular tongue and one of the side walls comprises two layers. In the closed disposition of the container, the tongue is inserted between these two layers.

SUMMARY OF THE INVENTION

Under consideration of the known packages, it is an underlying technical problem of the present invention to provide a package which is inexpensive to manufacture, sufficiently stable to protect the contents of the package and repeatedly and consistently openable and closeable. Further, it is an underlying technical problem of the present invention to provide a package blank for producing such a package.

According to one aspect of the present invention, this problem is solved by a package, folded from a single package blank and comprising front wall, back wall and side wall segments. The front and the back wall segments extend into congruent closure segments defining an end of the package. At least two of the closure segments overlay one another in a substantially coplanar manner to form a pocket with one open side, and at least a further one of the closure segments is inserted into the pocket from the open side thereof in such a manner as to permit repeatable opening and closing of the package end. The package further comprises tabs and flaps on margins of the segments to permit, by folding and attaching, formation of the package from the blank.

In another aspect according to the invention, there is provided a foldable package blank, comprising front wall, back wall and side wall segments. The front and the back wall segments extend into congruent closure segments. At least two of the closure segments are arranged to be foldable on top of one another to form a pocket with one open side, and at least a further one of the closure segments is arranged to be insertable into the pocket from the open side thereof in such a manner as to permit repeatable opening and closing of an end of the package. The blank further comprises tabs and flaps on margins of the segments to permit, by folding and attaching, formation of the package from the blank.

The package according to the invention provides significant advantages over previously known packages. It is designed such that closure segments which are substantially congruent, overlie one another in a substantially coplanar manner to form a pocket with one open side. A further one of the package closure segments is, in the closed disposition of an end of the package, inserted into this pocket from the open side thereof. The pocket of congruent closure segments consequently surrounds the further closure segment substantially entirely. A locking effect of the further closure segment in the pocket is thus achieved. As this locking effect is achieved without making use of any latching or notching action, consistent and reliable functioning of the closure mechanism in accordance with the present invention is obtained without wear of the constituting elements of the closure. To this end, the plane defined by the substantially coplanar closure segments can preferably be angled relative to the front wall and the back wall segments from which the closure segments extend, typically in an obtuse angle. In a further preferred embodiment, the pocket is dimensioned such that friction between the pocket and the further closure segment enhances the locking effect. The inventive solution advantageously permits a manufacturer to design the shape of the closure to resemble the shape of the packaged goods.

A preferred embodiment of the invention suggests a shape of the congruent closure segments, which is substantially triangular. Accordingly, the closure of the package resembles a peak. Alternatively, the congruent closure segments can be of substantially semi-circular shape.

A further preferred feature of the inventive solution contributes to the repeatable and consistent opening and closing of the package end. Accordingly, each side wall segment is provided with crease lines to permit relative movement between the front wall and the back wall segments when the further closure segment is moved between the open and closed dispositions of the package end. In particular, the crease lines permit to move the front and the back wall segments towards and away from one another by enabling mainly the respective side wall segments to deform. Accordingly, the front and the back wall segments can be moved substantially without deformation thereof.

It has been found that crease lines substantially in the shape of an inverted Y represent a particularly beneficial compromise between simple and less costly manufacturing and consistent deformation of the side wall segments. Additionally, storage space within the inventive package is maximized.

Generally, the package can be of any desired cross-sectional shape. However, for most space efficient storage of several packages, it is preferred that the packages are of substantially rectangular cross-section and/or the side wall segments and the front and the back wall segments are located on opposite sides of the package, respectively.

A further preferred embodiment of the inventive package, as regards repeatability and consistency of the opening and closing function, provides that the relative dimensions of the side wall segments and the closure segments are such that the side wall segments prevent opening of the package beyond a limited clearance between the further closure segment and the open side of the pocket. In particular, upon opening of the package end, the side wall segments straighten out along the crease lines and, when they are substantially straight, prevent further relative movement between the front wall and the back wall segments. This mechanical stop leaves a limited clearance between the further closure segment and the open side of the pocket, which is sufficient for inserting the further closure segment into the pocket. Typically, the clearance is dimensioned such that an end of the further closure segment slides on the wall segment of the package adjacent to the pocket so that insertion of the further closure segment into the pocket is more easily facilitated.

An important commercial aspect in the typical field of application of the present invention requires to provide a tamper evident closure mechanism of the package. To this end, at least one of the closure segments is provided with a tear strip.

In semi-automatic and automatic manufacturing and filling of the package, it has proven to be particularly efficient if the package further comprises a crash lock end. Preferably, the crash lock end is located at the bottom and the closure segments at the top of the package.

Many applications of the present invention require the package to hold goods which are sensitive as regards contamination. A particularly beneficial way to avoid contamination from the package material provides that the inventive package is, in accordance with a further preferred embodiment, made from a laminated compound blank material. This ebodiment of the present invention permits to provide a sterile inner compound. Additionally, this further embodiment permits to provide the outside of the inventive package with a layer of the desired aesthetic appearance while not compromising the carrier structure of the material in terms of strength and costs.

In the context of the present invention, terminologies such as "front" and "back" as well as "top" and "bottom" are used for the sake of simplification of the description and are not intended to limit the scope of the present invention, unless explicitly stated.

The inventive package blank referred to above preferably provides that the further closure segment is smaller than the remaining closure segments, to permit, upon complete insertion of the further closure segment into the pocket, abutment of the respective front and back wall segments. This abutment is provided by abutment of at least the edges of the wall segments from which the closure segments extend. Depending on the application of the present invention, the abutment thus provided can also be extended to cover an area of the respective wall segments.

Automatic manufacturing of the blank and the package from the blank requires high speed operations. To meet this requirement, the present invention advantageously further provides that the inventive blank is punched from one piece.

Those skilled in the art will be familiar with the methods of manufacture of the blanks of this invention, whether the blanks are made of plastic, paper or other suitable materials. They will also be able to select suitable methods of folding the blanks, possibly already about the product items to be packaged, and suitable ways of fixing the blank to form a package, which might be by means of adhesive if not welding or hot melt gluing.

BRIEF DESCRIPTION OF THE DRAWINGS

The invention is described in greater detail in the following, by way of purely exemplary embodiments represented schematically in the following drawings, in which.

DESCRIPTION OF THE PREFERRED EMBODIMENTS

In the following detailed description of preferred embodiments, similar reference signs are used throughout for the same or corresponding parts of the inventive package and the inventive package blank.

Figure 1:
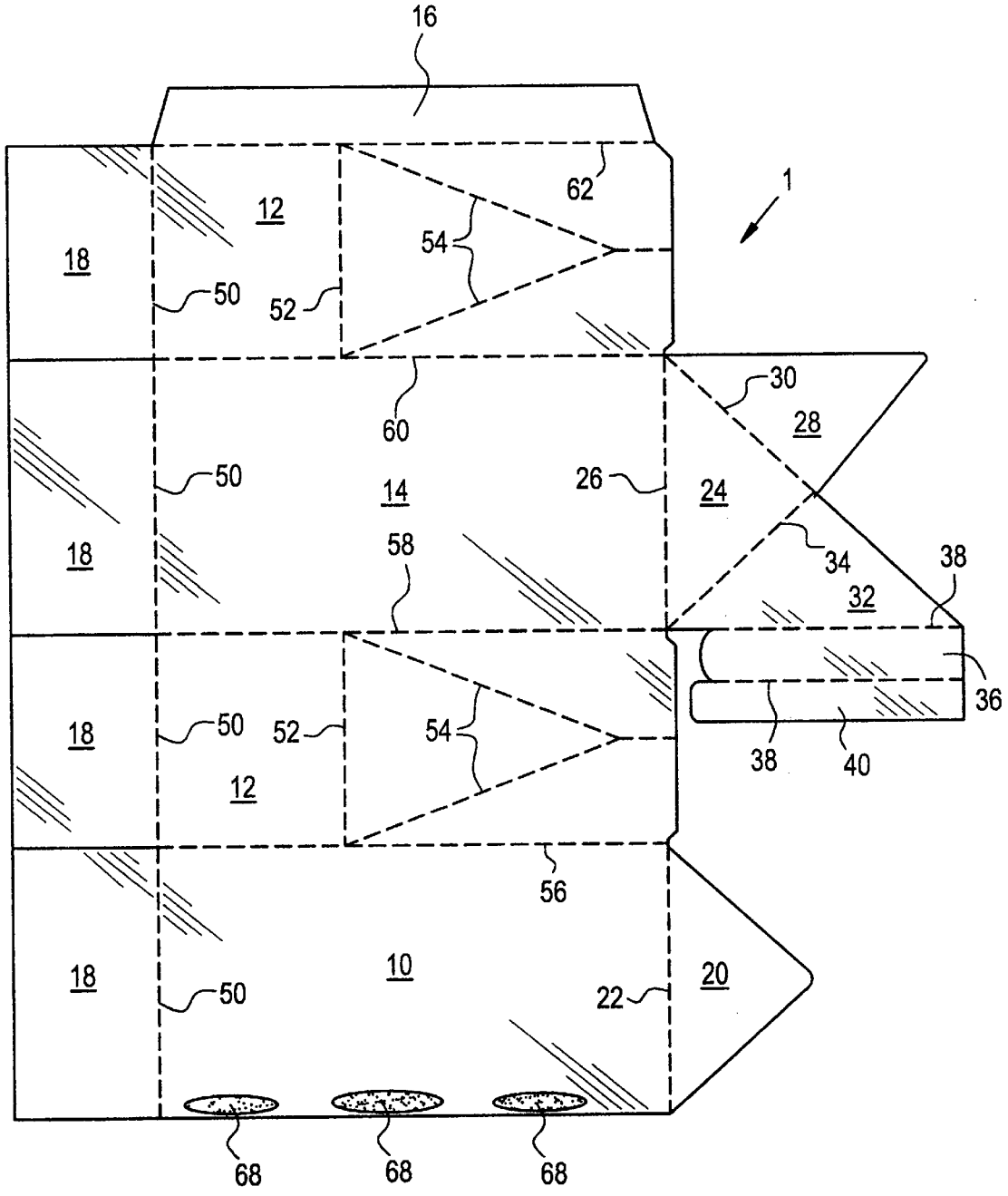
FIG. 1 shows a plan view of a package blank in accordance with the present invention.

A shipping, presentation and end user package according to the present invention is shown in FIG. 1 in plan view in its configuration after manufacture of the blank. It comprises, in the center of FIG. 1 from the bottom to the top thereof, a front wall segment 10, a side wall segment 12, a back wall segment 14, a further side wall segment 12 and a wall segment attachment flap 16. To the left of the various wall segments, bottom closure segments 18 are connected by crease or fold lines 50.

In this connection, it is to be noted that the crease lines or fold lines between the wall segments are adapted to enable folding of adjacent segments along these lines, substantially without deformation of the respective segments. A skilled person will be aware how to best embody this function.

Referring again to FIG. 1, an insertable closure segment 20 is connected to the front wall segment 10 by a crease line 22. To the right of back wall segment 14, a crease line 26 connects a pocket segment 24 which, in the completed package, forms the bottom of the pocket of the top closure of the package. A top pocket segment 28 is joined to the bottom pocket segment 24 by a crease line 30 and a pocket attachment segment 32 by a crease line 34. A tear strip 36 extends, in FIG. 1 from the bottom, from pocket attachment segment 32, connected to the latter by a perforation 38. A further perforation 38 on the opposite side of the tear strip 36 connects a closure attachment flap 40.

As is evident from FIG. 1, the various closure segments 20, 24, 28, 32 are shaped substantially as isosceles rectangular triangles. This preferred embodiment permits easy operation of the package. However, the skilled reader will readily take from the concept described herein how to embody the present invention with different shapes. In particular, it is intended to carry out the inventive concept in trapezoidal and semi-circular configurations.

Turning again to FIG. 1, the skilled reader will note inverted Y-shaped fold lines 54 on the side wall segments 12. Further crease lines 52 are located on the side wall segments 12 where the Y-shaped crease lines 54 meet the crease lines 56, 58; 60 62 that join the respective side wall segments to the adjacent segments. By placing crease lines 52 appropriately on the side wall segments 12, storage space within the package can be modified as desired to accommodate different goods to be packaged. The inverted Y-shape of crease lines 54 and their intersection at their bifurcated end with crease lines 52 on the one hand and crease lines 56, 58; 60 62 on the other hand enables relative movement of the front wall segment 10 towards and away from the back wall segment 14, as will be described in more detail below.

In this connection, it is to be noted that the inverted Y-shaped design permits this relative movement without affecting the storage space defined between crease lines 50 and 52.

Figure 2:
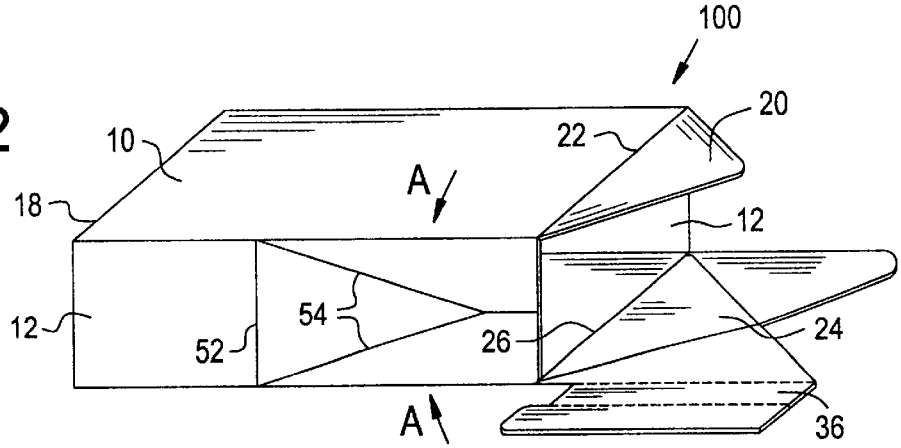
FIGS. 2 to 4 show perspective views of the inventive package blank in sequential manufacturing steps.

Now with reference to FIG. 2, an intermediate step of manufacturing the package 100 from the blank 1 is depicted. Relative to FIG. 1, the wall segment attachment flap 16 was folded along fold line 62 into a right angle relative to the adjacent side wall segment 12 which, in turn, was folded along crease line 60 into a right angle relative to back wall segment 14. Similarly, the front wall segment 10 was folded along crease line 56 into a right angle relative to its adjacent side wall segment 12 which, subsequently, was folded along crease line 58 so that the free edge of front wall segment 10 overlies wall segment attachment flap 16. Prior to folding, glue spots 68 were applied to front wall segment 10 to enable it to attach to wall segment attachment flap 16 (see FIG. 1). Although three spots of adhesive are depicted in FIG. 1, it is to be noted that the shape and arrangement of the "glue spots" can be modified as long as they serve the function of attachment. Naturally, in case a waterproof container is to be achieved, a skilled person will choose a means of attachment continuous and contiguous along the edge of front wall segment 10. As previously mentioned, other means of attachment are also contemplated, for example welding, hot melt gluing or heat sealing.

In the disposition depicted in FIG. 2, the bottom closure segments 18 have also been provided with glue spots and folded into a bottom closure, in a conventional manner.

In the erected state of the package depicted in FIG. 2, it can clearly be seen that the insertable closure segment 20 is located above bottom pocket segment 24. Arrows A in FIG. 2 indicate progress from the disposition shown in FIG. 2 to that shown in FIG. 3.

Figure 3:
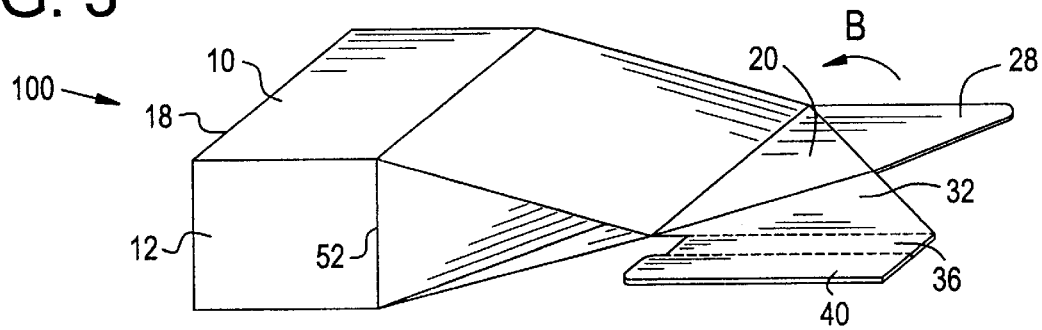

In particular, arrows A indicate how the side walls 12 are pressed towards the interior of the package and fold along crease lines 54, 52 to assume the shape depicted in FIG. 3. The region of front wall 10 adjacent to the insertable closure segment 20 and the corresponding region of the back wall segment move towards one another until crease lines 22 and 26 contact one another in edge to edge abutment.

Referring now to FIG. 3, it is evident to the skilled reader that the insertable closure segment 20 overlies the bottom pocket segment 24. The congruent shape of the insertable closure segment 20 and the bottom pocket closure segment 24 enables intimate surrounding contact in the closed disposition of the package. This intimate contact supplements the form-locking effect by means of congruent shapes with a force-locking effect by means of friction generated between the pocket segments 24, 28 and the further closure segment 20, so that the latter is securely held in the pocket, in the closed disposition of the package.

Figure 4:
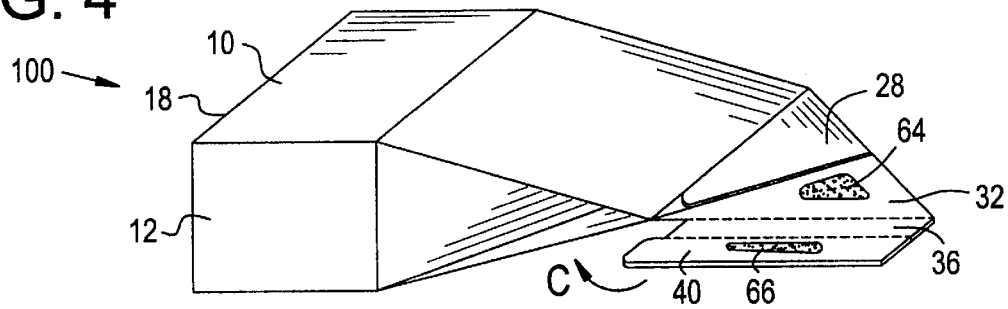

Arrow B in FIG. 3 indicates a subsequent manufacturing step progressing from the disposition show in FIG. 3 to that of FIG. 4. In FIG. 3 the top pocket segment 28 is folded along its corresponding fold line (30 in FIG. 1) to lie in a coplanar manner on top of the insertable closure segment 20. Top pocket segment 28 and insertable closure segment 20 are substantially free of any attachment means so that relative movement of the insertable closure segment 28 into and out of the pocket to be formed is enabled.

In FIG. 4, a subsequent manufacturing step is shown. In particular, glue spots 64 and 66 are applied to pocket attachment segment 32 and closure attachment flap 40, respectively. Again, the skilled reader will readily be aware of different means of attachment.

Figure 5:
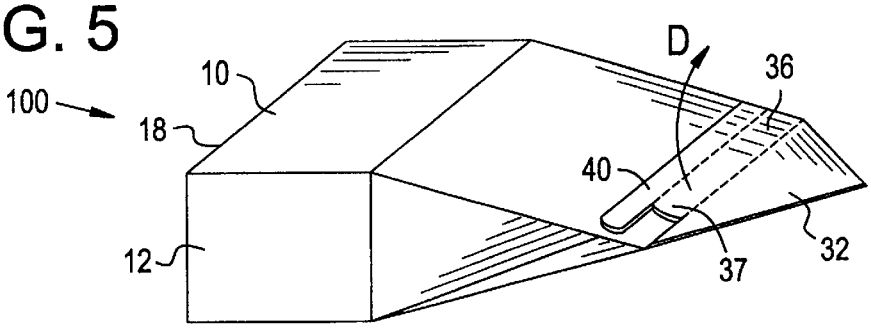
FIG. 5 shows a perspective view of the completed package in accordance with the present invention.

Subsequently, pocket attachment segment 32 with tear strip 36 and closure attachment flap 40 are folded in the direction of arrow C along the corresponding crease line (34 in FIG. 1). The completed disposition of the package depicted in FIG. 5 results.

On account of glue spots 64, pocket attachment segment 32 is attached to top pocket segment 28 and, consequently, completes by attachment the pocket between segments 24 and 28 in intimate contact around the insertable closure segment 20. Further, on account of glue spot 66, closure attachment flap 40 is attached to front wall 10 and, consequently, prevents the insertable closure segment 20 from sliding out of the pocket thus formed.

In order to open the package, tear strip 36 is gripped at its rounded gripping end 37 and torn off in the direction of arrow D which separates closure attachment 40 from pocket attachment segment 32.

Consequently, the insertable closure segment 20 is free to be extracted from the pocket formed by bottom pocket segment 24 and top pocket segment 28, by moving front wall segment 10 and back wall segment 14 toward and away from another. This relative movement is enabled by crease lines 54 and 52 in side wall segments 12.

The dimensions, in the figures only schematically represented, of the side wall segments 12 relative to the insertable closure segment 20 and its corresponding pocket permit relative movement between the front wall and the back wall segments to an extent until the side wall segments 12 near crease lines 54, 52 are straightened out. In this disposition, the tip of the insertable closure segment 20 is released from the top pocket segment 28 but still rests on the bottom pocket segment 24 or, alternatively, the back wall segment 14. Consequently, the package can be fully opened and is accessible. For reclosing the package, the tip of the insertable closure segment 20 can be brought into contact with the back wall segment 14 or the bottom pocket segment 24 and easily slid back into the pocket.

Resilient materials properties of the package blank permit relative movement between the front wall and the back wall segments substantially without deformation thereof. Further, these properties assist in providing the inventive package with a pleasant aesthetic appearance so that, in the closed disposition of the package, the top closure segments are aligned perpendicularly to the bottom closure 18 and the inclined parts of the front wall and the back wall segment are arranged symmetrically.

Additional embodiments of the invention can be provided with e.g. tape on the extended part of closure segment 32, which is glued onto a corresponding portion of the package, so that it is releasable in an easy manner for the consumer, as a tamper-proof closure. Other modifications of the tamper-proof closure could be provided by a slit or slot along crease line 22, in which a tongue-like element at the margin of closure segment 32 is insertable, or a releasable glue spot between closure segments 20 and 28. Naturally, other glue spots as illustrated can be provided on opposing package walls.

Further embodiments and advantages of the inventive package and the inventive package blank are defined in and by the various combinations of the following claims.

What is claimed is:

1. Package, folded from a single package blank and comprising:

front wall, back wall and side wall segments, the front and the back wall segments extending into congruent closure segments defining an end of the package, wherein at least two of the closure segments overlay one another in a substantially coplanar manner to form a pocket with one open side, and at least a further one of the closure segments is inserted into the pocket from the open side thereof in such a manner as to permit repeatable opening and closing of the package end, the package further comprising tabs and flaps on margins of the segments to permit, by folding and attaching, formation of the package from the blank.

2. Package as claimed in claim 1, characterized in that the shape of the congruent closure segments is substantially triangular or substantially semicircular.

3. Package as claimed in claim 1, characterized in that each side wall segment is provided with crease lines to permit relative movement between the front wall and the back wall segments when the further closure segment is moved between the open and closed dispositions of the package end.

4. Package as claimed in claim 3, characterized in that the crease lines comprise crease lines substantially in the shape of an inverted Y.

5. Package as claimed in claim 3, characterized in that the crease lines are located in a region of the side wall segments adjacent the package end.

6. Package as claimed in claim 1, characterized in that the side wall segments and/or the front and the back wall segments are located on opposite sides of the package, respectively.

7. Package as claimed in claim 1, characterized in that the package is of substantially rectangular cross-section.

8. Package as claimed in claim 1, characterized in that the relative dimensions of the side wall segments and the closure segments are such that the side wall segments prevent opening of the package beyond a limited clearance between the further closure segment and the open side of the pocket, the clearance being sufficient for inserting the further closure segment into the pocket.

9. Package as claimed in claim 1, characterized in that at least one of the closure segments is provided with a tear strip.

10. Package as claimed in claim 1, further comprising a crash-lock end.

11. Package as claimed in claim 1, wherein the package is made from a laminated compound blank material.

12. Blank, foldable into a package and comprising front wall, back wall and side wall segments, the front and the back wall segments extending into congruent closure segments, wherein at least two of the closure segments are arranged to be foldable on top of one another to form a pocket with one open side, and at least a further one of the closure segments is arranged to be insertable into the pocket from the open side thereof in such a manner as to permit repeatable opening and closing of an end of the package, the blank further comprising tabs and flaps on margins of the segments to permit, by folding and attaching, formation of the package from the blank.

13. Blank as claimed in claim 12, characterized in that the shape of the congruent closure segments is substantially triangular or substantially semicircular.

14. Blank as claimed in claim 12, characterized in that each side wall segment is provided with crease lines to permit, in the folded disposition of the blank, relative movement between the front wall and the back wall segments when the further closure segment is moved between the open and the closed dispositions of the package end.

15. Blank as claimed in claim 14, characterized in that the crease lines comprise crease lines substantially in the shape of an inverted Y.

16. Blank as claimed in claim 14, characterized in that, in the folded disposition of the blank, the crease lines are located in a region of the side wall segments adjacent the package end.

17. Blank as claimed in claim 12, characterized in that, in the folded disposition of the blank, the side wall segments and/or the front and the back wall segments are located on opposite sides of the package, respectively.

18. Blank as claimed in claim 12, characterized in that the blank is provided with four wall segments, to be foldable into a package of substantially rectangular cross-section.

19. Blank as claimed in claim 12, characterized in that the relative dimensions of the side wall segments and the closure segments are such that, in the folded disposition of the blank, the side wall segments prevent opening of the package beyond a limited clearance between the further closure segment and the open side of the pocket, the clearance being sufficient for inserting the further closure segment into the pocket.

20. Blank as claimed in claim 12, characterized in that the further closure segment is smaller than the remaining closure segments, to permit, upon complete insertion of the further closure segment into the pocket, abutment of the respective front and back wall segments.

21. Blank as claimed in claim 12, characterized in that at least one of the closure segments is provided with a tear strip.

22. Blank as claimed in claim 12, further comprising crash-lock bottom wall segments.

23. Blank as claimed in claim 12, wherein the blank is punched from one piece.

24. Blank as claimed in claim 12, wherein the blank is made from a laminated compound material.

* * * * *